US006709197B1

(12) United States Patent
Sargent et al.

(10) Patent No.: US 6,709,197 B1
(45) Date of Patent: Mar. 23, 2004

(54) LARGE CAPACITY BOAT LIFT

(75) Inventors: Charles L. Sargent, Bonita Springs, FL (US); Daniel S. Carter, Fresno, CA (US)

(73) Assignee: Quality Boat Lifts, Inc., Fort Myers, FL (US)

( * ) Notice: Subject to any disclaimer, the term of this patent is extended or adjusted under 35 U.S.C. 154(b) by 0 days.

(21) Appl. No.: 10/176,184

(22) Filed: Jun. 20, 2002

Related U.S. Application Data

(60) Provisional application No. 60/299,642, filed on Jun. 20, 2001.

(51) Int. Cl.[7] ..... B63C 3/06
(52) U.S. Cl. ..... 405/3; 114/44
(58) Field of Search ..... 405/3, 1; 114/44

(56) References Cited

U.S. PATENT DOCUMENTS 4,686,920 A * 8/1987 Thomas ..... 405/3
5,378,082 A * 1/1995 Hiller et al. ..... 405/3
5,593,247 A * 1/1997 Endres et al. ..... 405/3
5,769,568 A * 6/1998 Parkins et al. ..... 405/3

FOREIGN PATENT DOCUMENTS

WO 91/14619 * 10/1991 ..... 405/3

* cited by examiner

*Primary Examiner*—Frederick L. Lagman
(74) *Attorney, Agent, or Firm*—William E. Noonan

(57) ABSTRACT

A large capacity boat lift includes a lift assembly mounted on each side of a boat supporting platform. Each lift assembly includes a support structure that carries a winder. A lifting cable is operably attached at each of its ends to respective sections of the winder. A drive mechanism operates the winder in first and second directions to selectively wind the cable onto and off of the winder. The cable movably interengages a pair of pulleys carried by the platform. A section of the cable between the pulleys is engaged with the support structure such that winding the cable onto the winder raises the platform and unwinding the cable from the winder lowers the platform.

17 Claims, 8 Drawing Sheets

LARGE CAPACITY BOAT LIFT

RELATED APPLICATION

This application claims the benefit of U.S. Provisional Patent Application Ser. No. 60/299,642 filed Jun. 20, 2001.

FIELD OF THE INVENTION

This invention relates to a large capacity boat lift and, more particularly, to a lift capable of raising and lowering vessels having weights of 75,000 pounds and greater.

BACKGROUND OF THE INVENTION

Conventional boat lifts for heavy vessels normally employ a plurality of winder driven cables located on respective sides of a boat supporting platform. Pulleys are occasionally utilized to improve the mechanical advantage exhibited by the lift. However, such systems tend to exhibit a number of disadvantages. For one thing, the lift cable when being wound experiences an effect known as reeving wherein stress is exerted unevenly on individual segments of the cable between, for example, the winder, the respective pulleys and the tie-off point of the cable. An especially large force may be exerted on the cable segment that drops from the winder. This may result in premature cable wear and expensive cable replacement. Undesirable wear on the cable is also frequently caused because the cable rubs against the grooves of the winder and/or on the sides of the pulleys. This occurs due to the fleet angle formed between the plane of the winder groove or the pulley groove and the center line of the cable. This too may unduly stress the cable and necessitate premature repairs.

Conventional cable driven boat lifts also tend to permit undesirable longitudinal motion of the boat supporting platform during the raising and lowering operations. This results because the supporting cables effectively shift position longitudinally on the helix of their respective winder grooves as the winders are operated and the cables are wound and unwound. Preferably, the supported vessel should remain as longitudinally stationary as possible during the lifting operation.

SUMMARY OF THE INVENTION

It is therefore an object of the present invention to provide an improved large capacity boat lift that is capable of efficiently and effectively raising and lowering virtually all sizes of vessels and which is particularly suited for lifting boats having a weight of 75,000 pounds or more.

It is a further object of this invention to provide a cable operated boat lift that experiences much less cable wear than conventional lifts and which requires less frequent cable repair and replacement.

It is a further object of this invention to provide a cable oriented boat lift that substantially equalizes the tensile stresses on the individual segments of each cable.

It is a further object of this invention to provide a cable operated boat lift that reduces the reeving effect upon the cables.

It is a further object of this invention to provide a cable operated boat lift that permits minimal longitudinal movement of the boat supporting platform during the lifting operation.

This invention results from a realization that a highly efficient large capacity boat lift which exhibits equalized weight distribution on the cables and reduced longitudinal sway may be achieved by operably interconnecting both ends of each lifting cable to opposing grooves on a respective winder such that the cable is raised and lowered at each end.

This invention features a boat lift that includes a pair of axially rotatable winders mounted above the water on respective longitudinal sides of the boat to be lifted. Each of the winders is supported on a respective support structure. A boat supporting platform is disposed between the supporting structures and is operably interconnected to each winder by a respective lifting cable. The cable is attached proximate one of its ends to a first section of the winder and proximate an opposite second end to a spaced apart second section of the winder. Each cable is movably interengaged with an associated set of lower pulleys carried by the platform. An intermediate segment of the cable is also interengaged with the support structure by an upper pulley or otherwise. The winders are axially rotated, typically by respective drive mechanisms to longitudinally drive the respective cables and thereby selectively raise and lower the boat supporting platform. More particularly, when the winder is operated in a first direction to wind its respective cable thereon, the cable is raised to lift the platform. Conversely, when the winder is operated in an opposite direction, the cable is unwound from the winder and extended to lower the platform.

In a preferred embodiment, the cable may be interengaged with its associated lower support structure by means of one or more upper pulleys. The platform may carry at least one set of three axially rotatable lower pulleys on each side of the platform. In such versions, the cable is typically interengaged with a pair of upper pulleys carried by the support structure. The upper and lower pulleys are preferably in the same plane thus eliminating any fleet angle between them. Each upper pulley is located intermediate a respective pair of the lower pulleys carried by the platform. The cable extends alternately ran between the lower and upper pulleys. Typically, the number of lower pulleys exceeds the number of upper pulleys by one. When an even number of lower pulleys and an odd number of upper pulleys are utilized, a centrally located upper pulley remains rotationally stationary during the raising and lowering operations. The cable is one piece. Thus, when the lift is stationary each vertical segment of the cable carries the same load. Equalizing weight distribution prolongs cable life. All of the remaining pulleys rotate as the cable is longitudinally driven and interengages each pulley. Alternatively, when an even number of upper pulleys and an odd lower pulleys are utilized, a centrally located lower pulley (i.e. a lower pulley located between two upper pulleys) remains rotationally stationary during raising and lowering of the platform. All of the remaining pulleys again rotate in interengagement with the longitudinally driven cable. In each version, the stress differential on the individual cable segments is minimized and longitudinal movement of the platform is virtually eliminated.

The winders may be mounted on respective cable beams. Each cable beam may extend between a pair of support posts or pilings. Certain versions of this invention may incorporate at least a pair of winders and associated cables and pulleys on each side of the platform. Each winder may be driven by an associated motor and drive mechanism. Alternatively, a single motor drive mechanism may operate a pair of winders on each side of the lift platform.

DETAILED DESCRIPTION OF PREFERRED EMBODIMENTS

Other objects, features and advantages will occur from the following description of a preferred embodiment and the accompanying drawings, in which.

Figure 1:
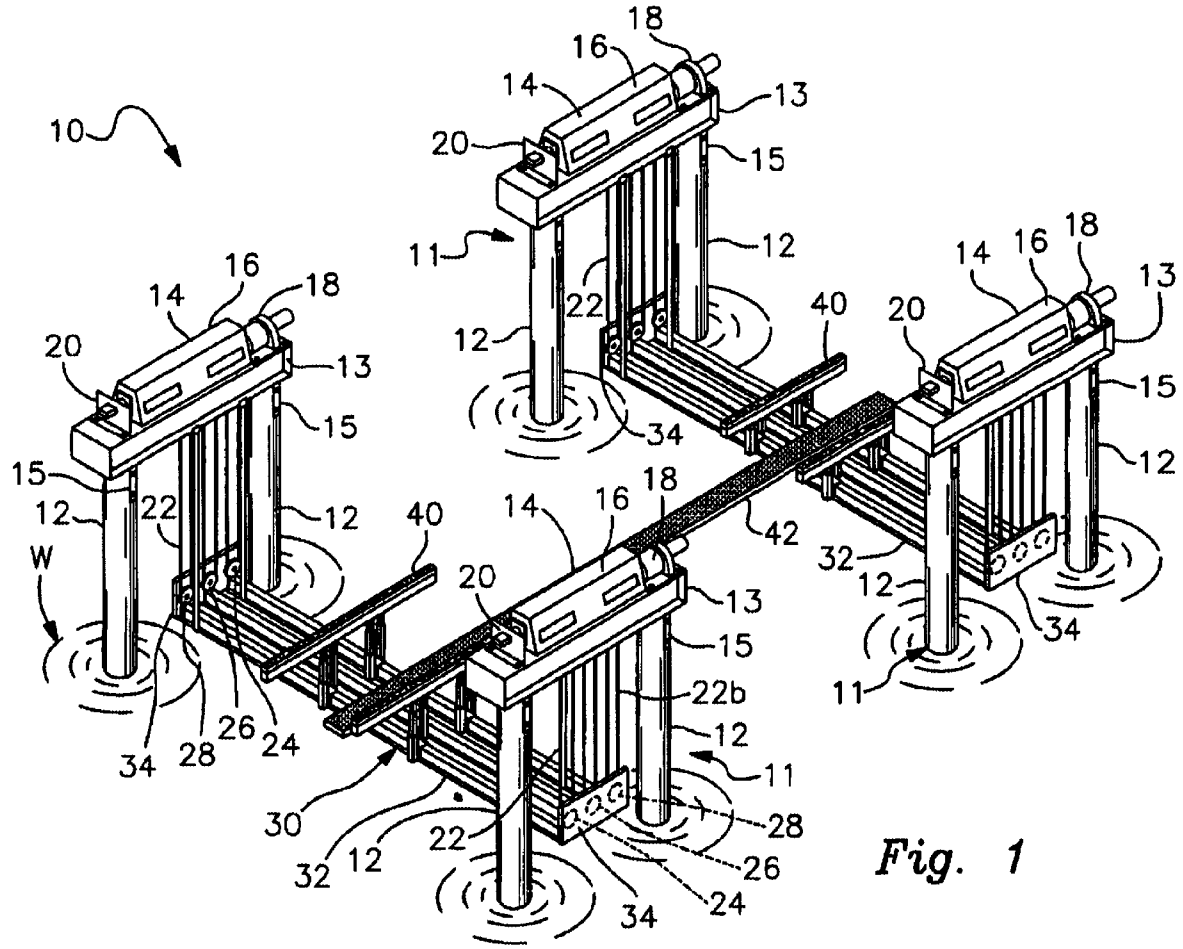
FIG. 1 is a perspective view of a preferred large capacity lift wherein a pair of lift assemblies according to this invention are provided on each side of the lift apparatus.

There is a shown in FIG. 1 a large capacity boat lift 10 that is particularly suitable for lifting yachts and other large vessels having weights of 75,000 pounds and greater. It should be understood that the particular lifting capacity of the apparatus is not a limitation of this invention and the lift may be utilized to raise and lower vessels having weights less than 75,000 pounds. Nonetheless, the construction of lift 10 is especially effective for raising and lowering heavier vessels. Lift apparatus 10 comprises four distinct lift assemblies 11, which are designed to selectively raise and lower a boat supporting platform 30. As will be described more fully below, each lift assembly 11 is situated adjacent, and is operably interengaged with a respective corner of the lift platform. It should be understood, however, that in alternative embodiments of this invention other numbers of lift assemblies similar to those shown may be employed.

Each lift assembly 11 includes a pair of pilings 12 or other type of support structure. Typically, pilings 12 are mounted adjacent to one another in a known manner in the bottom or floor of a body of water W. In the version show herein four pairs of pilings 12 are employed. Two pairs (i.e. two lift assemblies 11) are arranged on each side of the slip or other space that accommodates the vessel to be lifted. The four pilings on each side of the slip are arranged side-by-side in a generally linear fashion along each side of the vessel. It should be understood that in alternative embodiments, various other numbers and arrangements of pilings or other types of support means may be utilized on each side of the vessel.

Each pair of pilings 12 supports an elongate cable beam 13 that extends between the upper end of the respective pilings. Each cable beam 13 is secured to its supporting pilings 12 by appropriate means such as brackets 15, which are described in detail below. Each beam 13 supports a respective winder mechanism 14 above water W. More particularly, each winder mechanism includes a winder drum, hidden in FIG. 1, that is accommodated in an elongate housing or enclosure 16. The housing and enclosed winder drum are mounted on beam 13 such that the drum is axially rotatable in a manner that is described more fully below. A drive mechanism 18 is also attached to the upper surface of each beam 13. The drive mechanism is operably interconnected to the winder drum so that the drum may be driven selectively in opposing first and second directions. Once again, the details of the drive mechanism and its interengagement with the winder drum are described more fully below. A stop assembly 20 is mounted at the opposite end of beam 13 in interengagement with the winder drum. The construction and operation of this component are likewise described and illustrated more fully below.

Each lift assembly 11 also includes a multiple part lifting cable 22, which is operably attached at each end to the winder drum so that it may be selectively wound about that drum. Each cable 22 depends from the drum and operably interengages a plurality of a upper and lower pulleys mounted on beam 13 and platform 30, respectively. An upper series of pulleys, not shown in FIG. 1, are located in the cable beam 13 associated with the particular winder drum on which cable 22 is wound. A respective set of lower pulleys 24, 26 and 28 are axially rotatably mounted to one corner of boat supporting platform 30. More particularly, the platform includes a plurality of transversely extending cradle beams 32 that extend generally between a pair of opposing lift assemblies 11. In FIG. 1, a first group of three cradle beams 32 extends between a forward pair of opposing lift assemblies 11 and a second group of three cradle beams 32 extends between a second, rearward pair of lift assemblies. Each group of three cradle beams is interconnected by mounting plates 34 secured at respective transverse ends of the cradle beams. The cradle beams may be composed of wood, plastic or a corrosion resistant metal or metal alloy. The end plate 34 is likewise typically composed of a material that is resistant to corrosion. The end plates may be secured to the cradle beam by bolts or other suitable means of attachment. In the version shown in FIG. 1, two separate end plates 34 are formed along each side of platform 30. As a result, platform 30 is effectively formed in two discrete sections. In alternative embodiments, a single continuous end plate or other numbers of end plates may extend along each side of the platform and be secured to various numbers of cradle beams. In this way, the platform may be formed in a single or multiple sections. Each section may be associated with one pair or multiple pairs of lift assemblies.

Appropriate bunk boards 40 and 42 of the type known in the boating industry are secured to and extend across the cradle beams. At least one bunk board 42 interconnects the discrete sections of the platform. A boat, not shown, is maneuvered into the space between the opposing pairs of lift assemblies 11 and is supported on the bunk boards 40 and 42 of platform 30 in a known manner. It should be understood that the bunk boards and cradle beams may have various alternative configurations and constructions, which will be understood to persons skilled in the art. The manner of securing the bunk boards to the transverse cradles may be altered within the scope of this invention. Assorted types of brackets and fasteners may be utilized.

Each cable 22 is secured at each of its opposite ends to a respective winder drum and is operably interengaged with respective sets of upper pulleys (hidden in FIG. 1) and lower pulleys 24, 26 and 28. Operating the winder, in a manner described below, causes the cable to selectively raise and lower an associated corner of platform 30, and more particularly, one end of a group of adjoining, interconnected cradle beams 32. It should be understood that the cable may comprise a multiple or single filament component and may be composed of metal, plastic, rope or other material suitable for use in a boat lift. The term "cable" should be construed broadly and may comprise virtually any type of flexible, strong element that is capable of being wound on a winder drum and interengaged with pulleys.

Figure 2A:
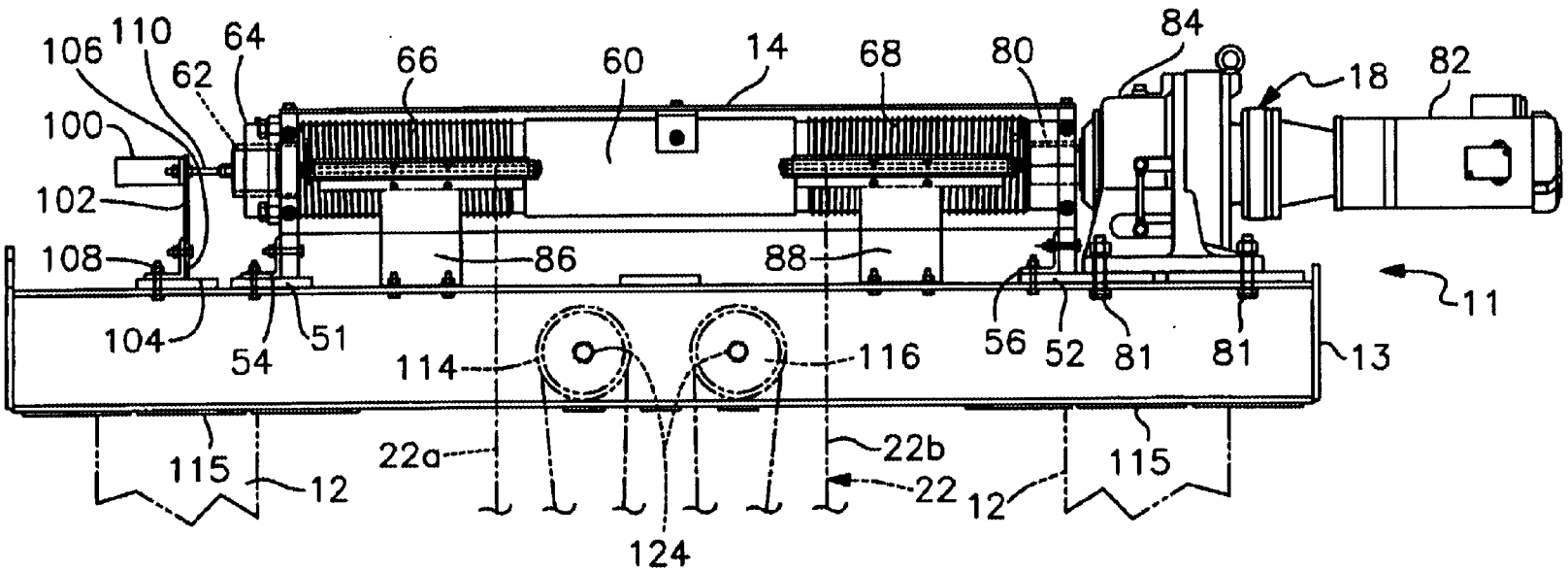
FIG. 2A is an elevational side view of the upper portion of a representative one of the lift assemblies.
Figure 2B:
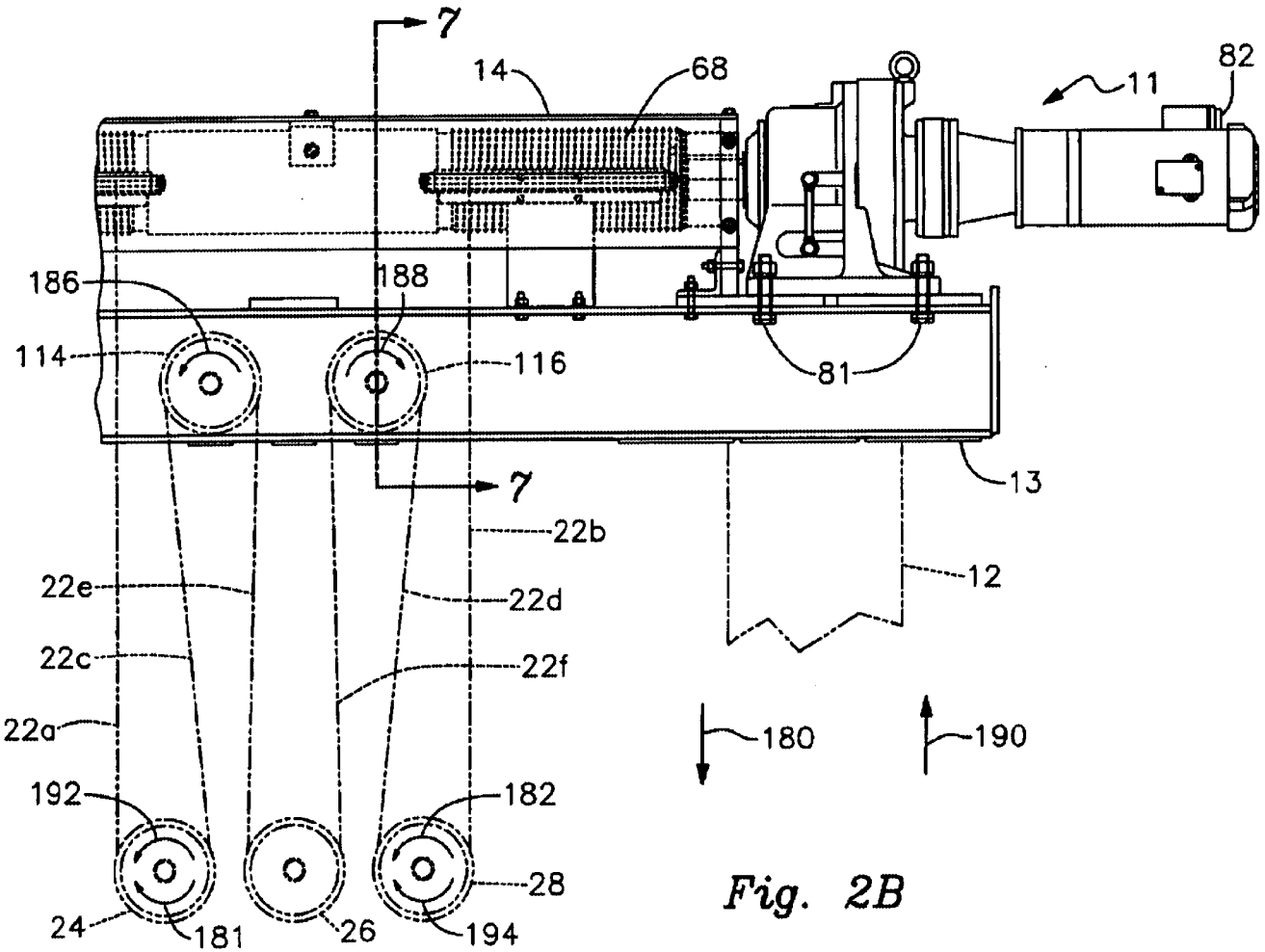
FIG. 2B is an elevational side view of a portion of one of the lift assemblies including the lower pulleys that are mounted to one side of the lift platform.
Figure 3:
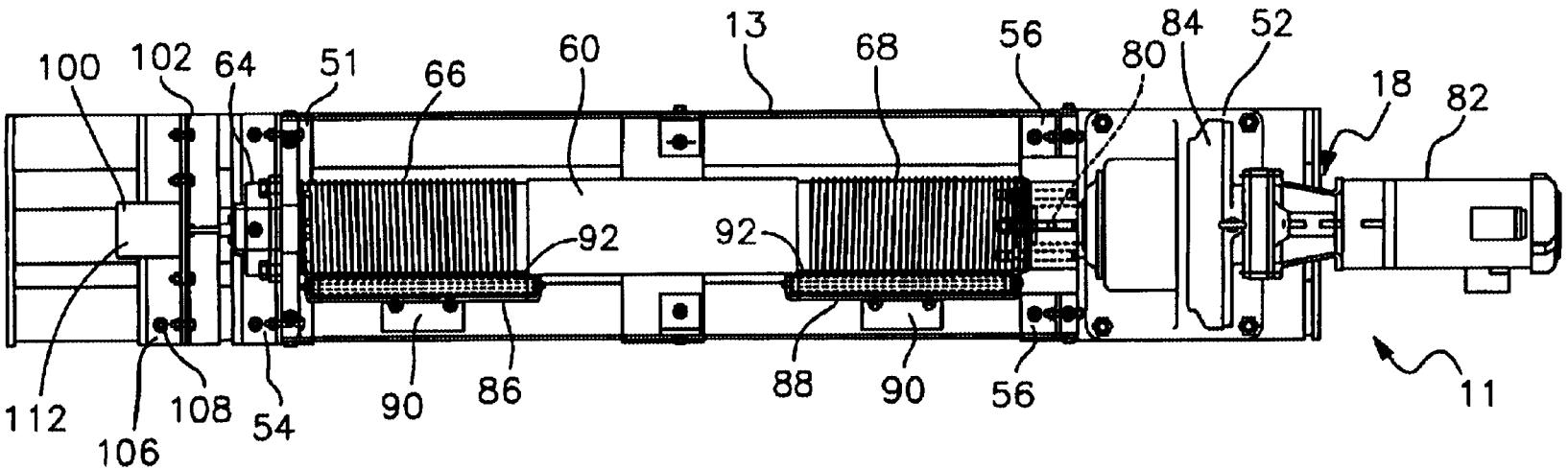
FIG. 3 is a top plan view of the lift assembly of FIGS. 2A and 2B.

A representative one of the lift assemblies 11 is depicted in FIGS. 2A, 2B and 3. In FIGS. 2A and 3 the front and upper walls, respectively, of housing 14 are removed for WA clarity. The longitudinal ends of housing 14 are mounted by respective support plates 51 and 52 to cable beam 13. More particularly, housing 14 is attached to plate 51 by an angle bracket 54 and associated bolts. The opposite end of the housing is likewise attached to plate 52 by a pair of angle brackets 56 and associated bolts.

Figure 4A:
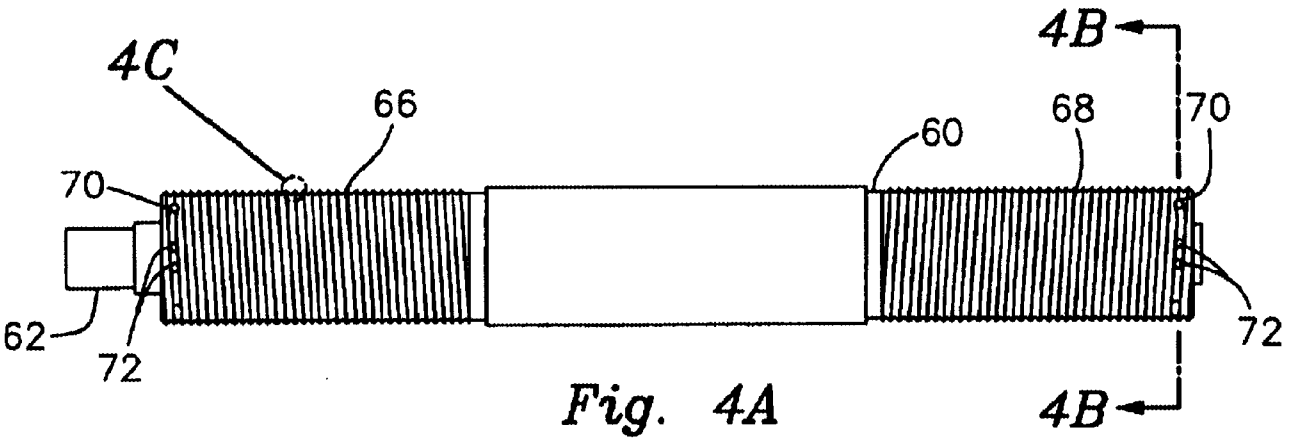
FIG. 4A is an elevational side view of a preferred winder.
Figure 4C:
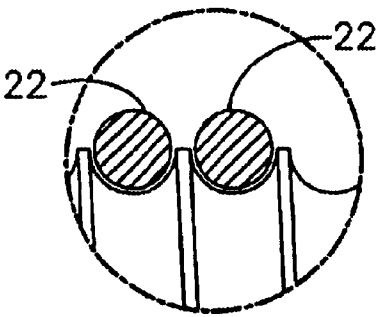
FIG. 4C is an enlarged view of the grooves employed in the winder.
Figure 4B:
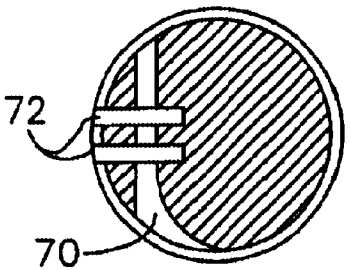
FIG. 4B is a cross sectional view taken along line 4B—4B of FIG. 4A.

A winder drum 60 is supported for axial rotation within housing 14 and, more particularly, includes a distal axle 62 that is received in a bearing 64 attached to the distal (left-hand) end of housing 14. Winder drum 60, which is shown alone in FIG. 4, includes a pair of circumferentially grooved sections 66 and 68 that are formed proximate respective ends of the drum. Each grooved section comprises a threaded or spiral groove that is cut into the circumference of the drum by an appropriate cutting tool. Each groove extends inwardly along drum 60 from a respective end of the drum. Section 66 comprises a righthand spiral and section 68 is a mirrored left-hand spiral. A cable receiving hole 70 is formed in each grooved section proximate a respective end of the winder drum. This hole receives a respective end of cable 22, which is secured in place by set screws received in holes 72. In this manner, cable 22 is secured at each end of the cable proximate respective ends of winder drum 60. The diameter and number of turns exhibited by each grooved section may be varied within the scope of this invention. However, in certain preferred embodiments, approximately thirty turns or winds are formed in each grooved section and the groove has a dimension capable of accommodating a cable with a diameter of approximately 7⁄16". FIG. 4C depicts an enlarged portion of one of the grooved sections with cable 22 accommodated in the groove.

Referring again to FIGS. 2A, 2B and 3, winder drum 60 is connected through a reducer 80 to drive mechanism 18. The drive mechanism is secured by bolts 81 that interconnect the drive to support plate 52 and the upper surface of beam 13. The drive mechanism includes a motor 82, which may exhibit various speeds and horsepowers. The motor is connected through a reduction mechanism 84 to reducer 80 that is in turn secured and transmits rotation to winder 60. The reduction mechanism may include a cycloidial reducer or other form of reduction means (e.g. gears, belts and pulleys or chains and sprockets) known to persons skilled in the art. When the motor and reduction mechanism are actuated, they drive winder drum 60 to axially rotate. The motor is operable in two directions such that the winder drum may be rotated to either raise or lower the attached cable as needed.

A pair of keeper roller assemblies 86 and 88 are mounted within housing 14 for engaging the segments of cable 22 wound about grooved winder sections 66 and 68 respectively. Each roller assembly includes a mounting bracket 90 that supports an elongate roller 92 in rotatable interengagement with the cable 22 wound about drum 60. The roller 92 of assembly 86 bears against the cable wound about groove 66. Likewise, the roller of assembly 88 bears against the cable received by grooved section 68. Each of the mounting brackets 90 is secured by appropriate bolts to the upper surface of beam 13. As the winder is rotated and cable 22 is wound onto or off of the winder, the keeper rollers 92 bear against the cable and help to prevent the cable from slipping out of the grooves and thereby disrupting operation of the lift assembly.

An automatic stop mechanism 100 is also mounted on the upper surface of beam 13 proximate the distal end of the winder housing 14. More particularly, automatic stop 100 is supported at the upper end of a transverse plate 102 that is in turn secured to a support plate 104 on beam 13 by an angle bracket 106 and associated bolts 108. Automatic stop mechanism 100 is disclosed more fully in co-pending application Ser. No. 09/531,984 filed Mar. 20, 2000. The description contained in that application is incorporated herein by reference. More particularly, the automatic stop mechanism includes a shaft 110 that is interconnected with winder drum 60. A constrained nut mounted within the enclosure 112 of mechanism 100, and not shown herein, is driven along shaft 110 as the winder drum rotates. The constrained nut eventually engages one of a pair of limit switches (hidden) within 112. Actuation of one of the switches stops rotation of the winder drum in a first direction and actuation of the other switch halts operation of the winder drum in the other direction. As a result, the automatic stop limits raising and lowering of the lift assembly.

Figure 5:
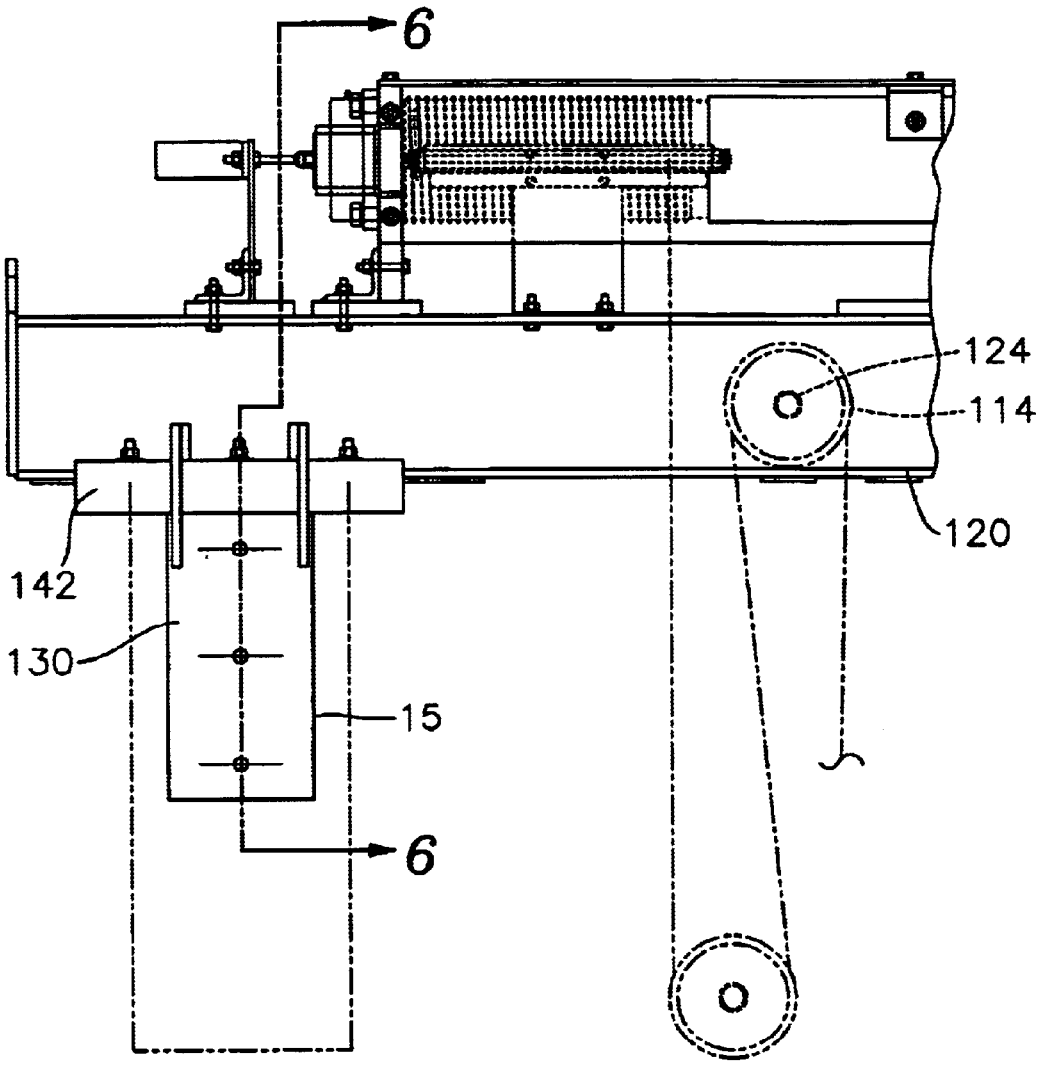
FIG. 5 is an elevational view of the left-hand side of a representative lift assembly illustrating how the lift assembly may be mounted on a support piling.
Figure 6:
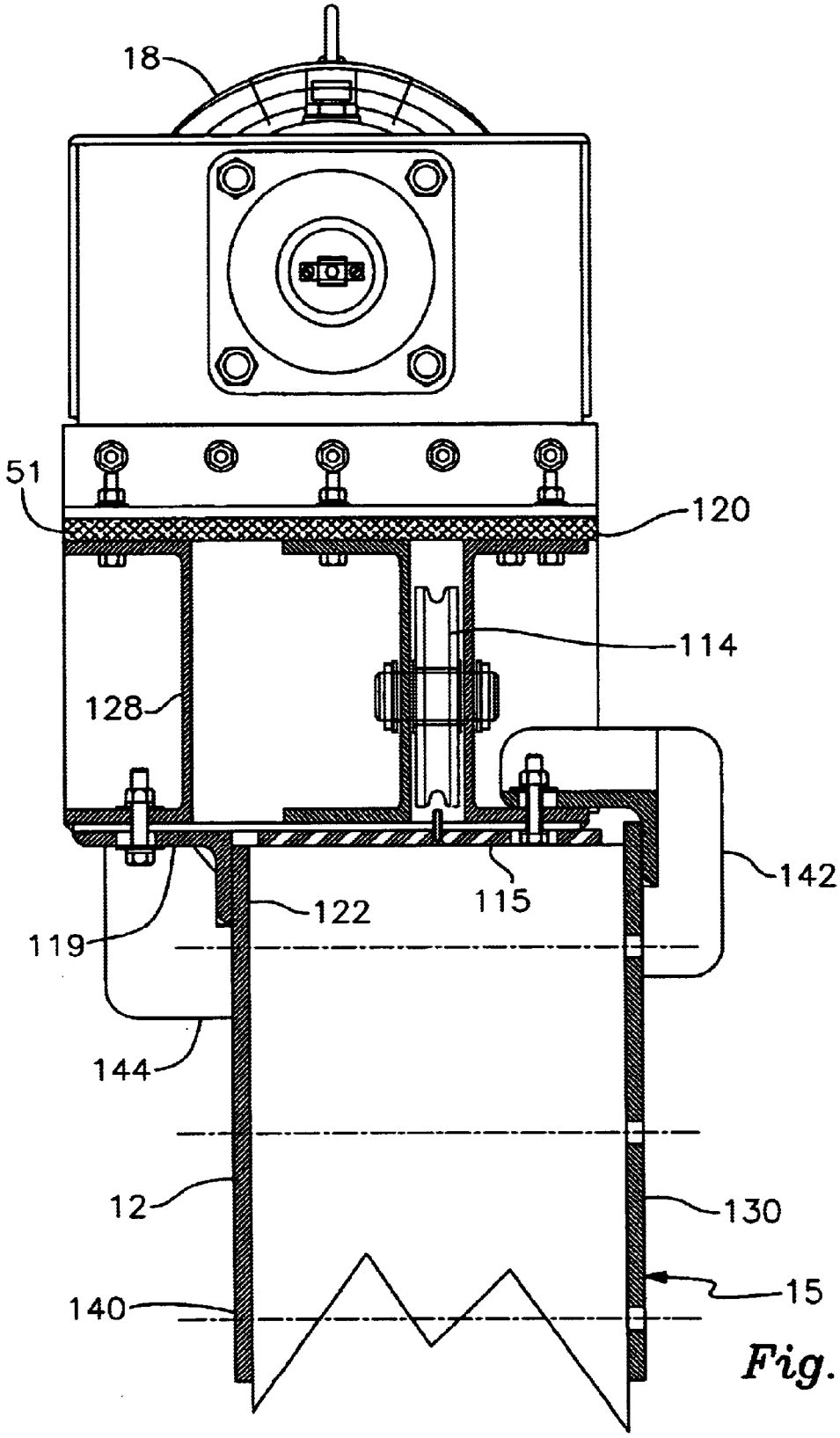
FIG. 6 is a cross sectional view taken along line 6—6 of FIG. 5.
Figure 7:
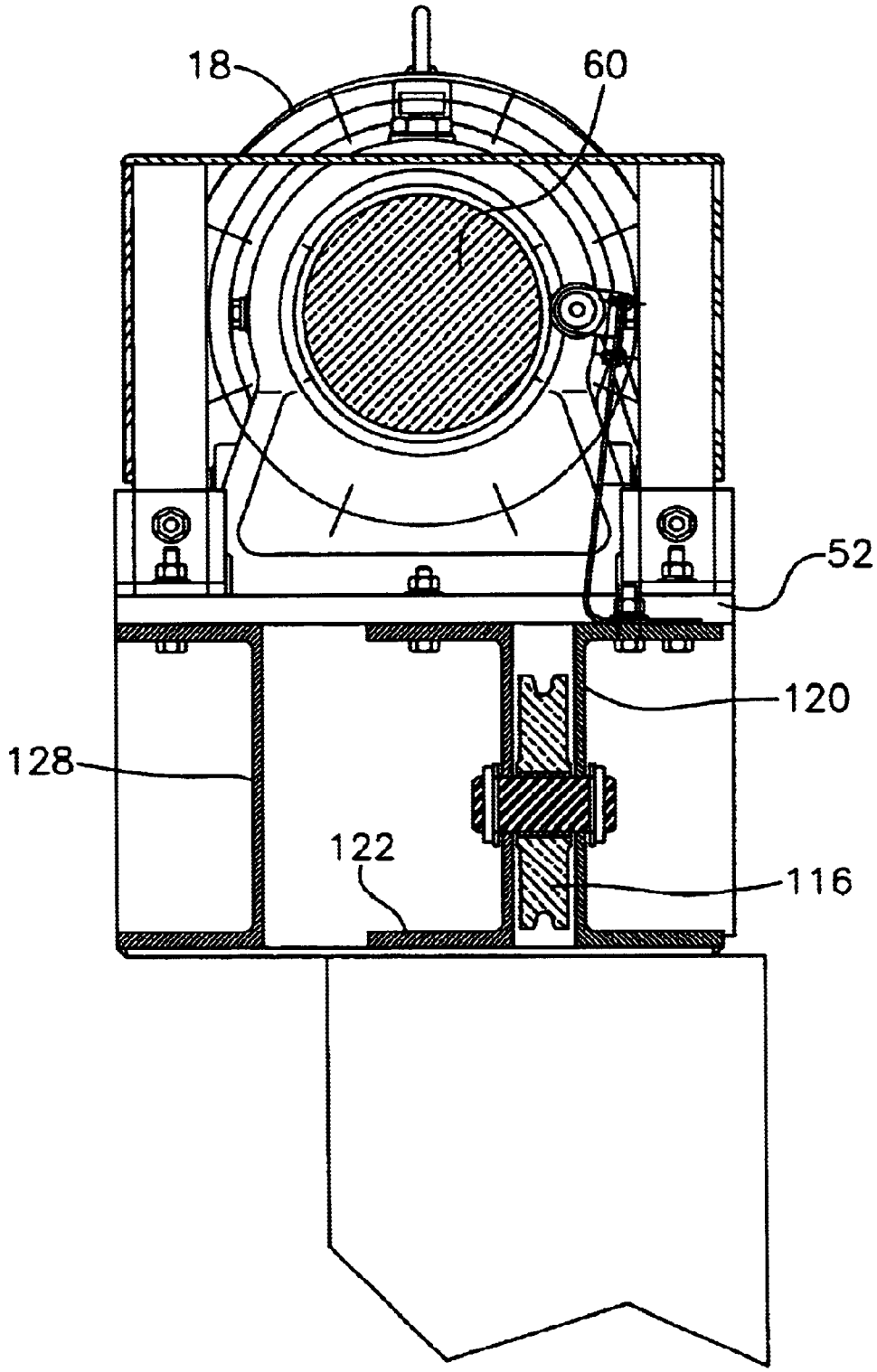
FIG. 7 is a cross sectional view taken along line 7—7 of FIG. 2B.

Cable beam 13 comprises a generally rectangular beam that is composed of aluminum, plastic or similar durable, rugged and corrosion resistant material employed in the boat lift industry. As shown in FIGS. 2A, 2B and 5–7, a plurality of upper sheave assemblies or pulleys 114 and 116 are axially rotatably mounted to beam 13. More particularly, as best shown in FIGS. 5–7, beam 13 comprises a pair of C-channel components 120 and 122 that are arranged longitudinally side-by-side in an opposing fashion. Each of the C-channel elements 120 and 122 is interconnected along its lower flange to plates 115 that are engaged with the upper surfaces of respective pilings 12. The upper flange of each channel element is likewise secured to the previously described plates 104, 51 and 52. Such attachment is typically accomplished by bolts (shown in the accompanying drawings) or other suitable means of attachment.

Pulleys 114 and 116 are mounted between elements 120 and 122 on respective shafts 124. A third elongate C-channel component 128, FIGS. 6 and 7, is mounted a proximate one end between a lower angle bracket 119 attached to piling 12 and plate 51. The opposite end of channel 128 is similarly mounted between a like angle bracket attached to the other piling and plate 52, FIG. 2A. The inwardly facing longitudinal surface of beam 13 (i.e. the side facing opposite element 128) is open to facilitate access to the upper pulley shaft 124. See FIGS. 6 and 7.

Cable beam assembly 13 is secured to the upper end of each of the associated pilings 12 by bracket 15 shown in FIGS. 5 and 6. In particular, a pair of forward and rearward straps 130 and 140 are secured to each piling 12 by bolts or similar fasteners. Forward and rearward piling attachments 142 and 144 are secured to plate 115 and element 128 respectively by bolts or like fasteners. Attachments 142 and 144 interengage the elements 122 and 128 of beam 13 and help to hold those elements securely on each piling 12.

The three lower pulleys 24, 26 and 28 are best depicted in FIG. 2B. As previously described, each of these pulleys is axially rotatably mounted to a plate 34 defining a side of platform 30. In the version shown herein, the upper and lower sets of pulleys are arranged in an axially parallel manner and are oriented generally within the same plane. However, in alternative embodiments, the individual pulleys may be arranged at differing orientations. For example, the upper pulleys may be arranged such that they are axially perpendicular to the lower pulleys. It is not required that all of the pulleys be arranged in the same plane or be axially parallel to one another.

As best shown in FIGS. 2A, 2B and 5, cable 22 depends or hangs from grooved sections 66 and 68 of winder drum 60. In particular, as previously described, one end of cable 22 is fastened to winder section 66 proximate the distal (left-hand) end of the winder. The cable is wound about the grooves in section 66 and depends from the winder as cable segment 22*a*. The opposite end of the cable is similarly attached to grooved section 68 of winder drum 60. That end portion of the cable is likewise operably engaged with the grooves of section 68 and the cable depends from section 68 as illustrated by cable segment 22*b*. Cable segments 22*a* and 22*b* hang downwardly from winder 60 through the gap between C-channel elements 120 and 122, FIGS. 6 and 7. Segments 22*a* and 22*b* extend downwardly until they eventually engage lower pulleys 24 and 28 respectively. See FIGS. 1 and 2B. Pulleys 24 and 28 cause the multiple part cable to reverse direction. As best shown in FIG. 2B, cable segment 22*c* extends upwardly from pulley 24 and eventually engages upper pulley 114. Likewise, cable segment 22*b* extends upwardly from pulley 28 until it engages upper pulley 116. Once again, segments 22*c* and 22*d* extend through the gap between the elongate C-channel elements 120 and 122 of beam 13.

Upper pulleys 114 and 116 again reverse the direction of the cable. A cable segment 22*e* drops from pulley 114 and engages central lower pulley 26. Similarly, cable segment 22*f* drops from upper pulley 116 until it eventually engages central lower pulley 26. Cable 22 therefore drops from grooved section 66 and sequentially interengages pulleys 24, 114, 26, 116 and 28. The cable then returns to grooved section 68 of winder drum 60 wherein it is wound about and attached to the winder drum in the above described manner.

Each lift assembly 11 is constructed in the foregoing manner or in an analogous manner within the scope of this invention. Various alternative constructions are contemplated within the scope of the invention. For example, each lift assembly may include various other numbers of upper and lower pulleys. Typically, in each lift assembly, the platform will carry one more pulley than is mounted on the corresponding cable beam. In some versions, an odd number of upper pulleys and an even number of lower pulleys may be employed. It should be noted that, in either case, the central pulley of the set featuring an odd number (which is central lower pulley 26 in the version described herein) may comprise a fixed point of attachment rather than a sheave assembly or pulley. This is because the cable does not movably engage pulley 26 or such other central point of attachment. Movable engagement is exhibited between the cable and the remaining pulleys in the manner described below.

Lift apparatus 10 is raised and lowered by operating each of the lift assemblies 11 in a synchronous manner. This may be accomplished by wiring the motors 82 so that the respective lift assemblies are operated in unison. It should also be noted that a single motor may be mounted between adjoining pairs of winders on each side of the lift apparatus. If the motor is interconnected to a pair of adjoining winders, those winders are then be synchronously and efficiently driven in a selected direction by a single motor. In the embodiment shown herein, the lift apparatus may therefore be driven by two rather than four motors.

In operation, the motor 82 of each lift assembly is operated in a first direction to wind cable 22 onto the winder and therefore raise the platform. Alternatively, the motor may be operated in an opposite direction to unwind the cable from winder 60 and thereby lower platform 30. When the motor is operated in the first direction, cable segments 22a and 22*b* are wound onto grooved sections 66 and 68 respectively. This causes pulleys 24, 26 and 28 to be pulled upwardly in the direction of arrow 180, FIG. 2B. As cable 22 interengages and is drawn through pulleys 24 and 28, pulley 24 rotates in the clockwise direction of arrow 181 and pulley 28 rotates in the counterclockwise direction indicated by arrow 182. At the same time, the cable is drawn through pulleys 114 and 116 causing them to rotate in the opposing directions indicated by arrows 186 and 188. This causes segments 22*e* and 22*f* of cable 22 to be pulled simultaneously upwardly in the direction of arrow 180. Pulley 26 is drawn upwardly; but due to the equal but opposing forces exerted on segments 22*e* and 22*f*, pulley 26 does not rotate. As pulleys 24, 26 and 28 are raised, they elevate the attached plate 32 of platform 30. This lifting operation occurs simultaneously in each of the lift assemblies 11 so that platform 30 and the boat supported thereon are raised evenly and efficiently out of the water. Necessary maintenance and repairs may then be performed.

The platform and vessel supported thereon are subsequently lowered by simply reversing the foregoing operation. Motor 82 is switched to run in an opposite direction. Winder drum 60 is thereby driven such that cable 22 is unwound from grooved sections 66 and 68. Cable segments 22*a* and 22*b* are thereby lowered in the direction of arrow 190. As the cable is deployed downwardly, pulley 24 is driven in the counterclockwise direction indicated by arrow 192 and pulley 28 is rotated clockwise as indicated by arrow 194. Upper pulleys 114 and 116 likewise reverse the rotation described above, with pulley 116 rotating in a clockwise direction and pulley 116 turning in a counterclockwise direction. Cable segments 22*e* and 22*f* are extended downwardly in the direction of arrow 190 such that central pulley 26 is lowered in the same direction. Indeed, as cable 22 is unwound from winder drum 60, all three of the pulleys 24, 26 and 28 are lowered with platform 30 in the direction of arrow 190. When all of the lift assemblies are operated in this manner, the entire platform 30, FIG. 1, is lowered in synchronized fashion. The vessel supported by the platform is thereby returned to the body of water W.

A number of advantages result from the use of the foregoing structure and make lift apparatus 10 especially suited for use with heavy vessels. Significantly, tensile force is exerted much more evenly or uniformly upon the respective cable drops or segments 22*a*–22*f*. In conventional devices wherein one end of the cable is tied-off or anchored to either the platform or the support structure, stress is distributed very unevenly to the individual cable segments. This can cause premature cable wear, which may require expensive repairs and replacements. In the version described herein, the force differentials and reeving effect are significantly reduced because the winder lifts a single, one-piece cable from both ends of the cable. When the lift is stationary, each vertical segment or drop of the cable carries the same load. Weight is distributed much more evenly along the cable. Overall stress on the cable is reduced dramatically. As a result, premature cable failure and frequent, expensive repairs are largely avoided. The system employed by this invention does exhibit less mechanical advantage because both ends of the cable are simultaneously lifted by the winder; however, this loss in mechanical advantage may be overcome by employing more efficient reduction means in reducer 84, FIGS. 2 and 3.

A further advantage exhibited by lift apparatus 10 is that each lift assembly virtually eliminates longitudinal movement of the lower pulleys, and therefore the boat supporting platform, relative to the winder. Because the platform is supported by two segments 22*a* and 22*b* of the same cable 22 attached to mirrored grooved sections 66 and 68 of the winder 60, the lower pulleys and platform 30 remain virtually stationary relative to the longitudinal axis of the winder as the cable 22 is wound onto or deployed from the winder. This provides for a much more stable and safer lifting and lower operation. The platform and supported vessel remain longitudinally stationary and do not shift or sway in fore and aft directions they are being raised and lowered.

Winder 60 also minimizes the rubbing against the winder grooves that a cable normally experiences when it is wound onto or off of a grooved winder. As the cable segments 22*a* and 22*b* are unwound and extended, the position from which each segment depends from winder drum 60 moves longitudinally toward the respective end of the winder at which the cable is attached. Conversely, as the winder winds the cable, the position from which the cable segment drops from the winder moves inwardly toward the longitudinal center of the winder. As a result, each of the cable segments 22*a* and 22*b* drops from the winder at a virtually constant angle relative to the longitudinal axis of the winder at all times during the raising and lowering operations. This causes the cable to maintain a consistent profile within its respective grooved section. See FIG. 4C. There is little, if any, fleet angle between the plane of each winder groove and the longitudinal axis of the cable. Rubbing between the cable and the edge of each groove is minimized. This further reduces cable wear and prolongs cable life. Moreover, the upper and lower pulleys are coplanar such that fleet angle between the pulleys is avoided.

Various alternative configurations of this invention may be employed. For example, two winders driven by a single motor may be mounted along each side of the platform. For exceptionally large vessels, three or even more lift assemblies, as previously described, may be employed along each side of the platform. Once again, in these versions, multiple winders may be operated by a respective motor.

From the foregoing it may be seen that the apparatus of this invention provides for a large capacity boat lift. While this detailed description has set forth particularly preferred embodiments of the apparatus of this invention, numerous modifications and variations of the structure of this invention, all within the scope of the invention, will readily occur to those skilled in the art. Accordingly, it is understood that this description is illustrative only of the principles of the invention and is not limitative thereof.

Although specific features of the invention are shown in some of the drawings and not others, this is for convenience only, as each feature may be combined with any and all of the other features in accordance with this invention.

Other embodiments will occur to those skilled in the art and are within the following claims.

What is claimed is:

1. A lift apparatus for selectively raising and lowering a marine vessel out of and into a body of water, said apparatus comprising:

a support structure locatable beside the vessel to be lifted and extendable above the body of water;

a continuously elongate winder for axially rotatably mounting on said support structure above the body of water, said winder including a spaced apart pair of integrally connected and circumferentially grooved sections located proximate respective distally opposing ends of said winder;

a single motor for axially driving said elongate winder such that both grooved sections rotate in unison;

a marine vessel supporting platform disposed beside said support structure; and a lift cable assembly operably interconnecting said winder and said platform, said lift cable assembly having a first cable end portion that is windably engaged with one of the grooved sections of the winder and a second cable end portion that is windably engaged with the other grooved section of the winder, said cable assembly including at least two dependent cable portions that are disposed longitudinally intermediate said first and second end portions, each removably engaging a respective lower pulley carried by said platform and at least one upper cable portion that is disposed longitudinally intermediate a respective pair of said dependent cable portions and interengaged with said support structure, whereby said winder is axially rotated in a first direction by said single motor to wind said end portions of said cable assembly onto respective grooved sections of said winder and raise said platform, said winder being axially rotated in an opposite second direction to unwind said cable assembly therefrom and lower said platform.

2. The apparatus of claim 1 in which said cable assembly has a serpentine configuration between said opposing end portions thereof.

3. The apparatus of claim 1 in which said support structure carries at least one upper pulley that is interengaged by a respective upper cable portion.

4. The apparatus of claim 3 including at least three lower pulleys for being movably interengaged by respective dependent cable portions, and further including at least a pair of said upper pulleys, each for being movably interengaged by a respective upper cable portion positioned longitudinally between respective adjacent pair of said dependent cable portions.

5. The apparatus of claim 4 in which said lower pulleys included axes that are substantially coplanar.

6. The apparatus of claim 4 in which said upper pulleys are mounted at substantially equal heights on said support.

7. The apparatus of claim 3 in which said upper and lower pulleys are substantially vertically coplanar such a fleet angle is lacking between said upper and lower pulleys.

8. The apparatus of claim 3 in which said cable assembly extends alternately between said lower and upper pulleys.

9. The apparatus of claim 3 in which said cable assembly includes a plurality of vertical cable segments, each extending between a lower pulley and one of said winder and a respective said upper pulley, each cable segment supporting an equal portion of a load supported by said platform.

10. The apparatus of claim 1 in which said cable comprises a single, continuous and unbroken one piece element extending between said opposing end portions.

11. The apparatus of claim 1 in which said support structure includes a cable beam for rotatably supporting said winder.

12. The apparatus of claim 11 in which support structure includes a pair of pilings for mounting in the body of water, said cable beam extending between said pilings.

13. The apparatus of claim 1 further including a drive mechanism for selectively turning said winder in said first and second directions.

14. A lift apparatus for use in combination with a support structure located beside a marine vessel to selectively lift and lower the vessel out of and into a body of water adjacent to the vessel, said apparatus comprising:

a continuously elongate winder for axially rotatably mounting on the support structure above the body of water, said winder including a spaced apart pair of integrally connected and circumferentially grooved sections located proximate respective distally opposing ends of said winder;

a single motor for axially driving said winder such that both grooved sections rotate in unison;

a marine vessel supporting platform disposed beside the support structure; and a lift cable assembly operably interconnecting said winder and said platform, said lift cable assembly having a first cable end portion windably engaged with one of said grooved sections and a second cable end portion windably engaged with the other grooved section, said cable assembly including at least two dependent cable portions that are disposed longitudinally intermediate said first and second end portions, each for movably interengaging a respective lower pulley carried by said platform and at least one upper cable portion that is disposed longitudinally intermediate a respective pair of said dependent cable portions and interengaged with said support structure, whereby said winder is axially rotated in a first direction by said single motor to wind said end portions of said cable onto respective grooved sections of said winder and raise said platform, said winder being axially rotated in an opposite second direction to unwind said cable assembly therefrom and lower said platform.

15. A lift apparatus for selectively raising and lowering a marine vessel out of and into a body of water, said apparatus comprising:

at least one support structure locatable on a first side of the vessel to be lifted and at least one support structure locatable on a second side of the vessel, each support structure being extendable above the body of water;

a plurality of continuously elongate winders, each for axially rotatably mounting on a respective one of said support structures above the body of water, each winder including a spaced apart pair of integrally connected and circumferentially grooved sections located proximate respective distally opposing ends of said winder;

each winder having a single motor associated therewith for axially driving said elongate winder such that both of said grooved sections rotate in unison;

a marine vessel supporting platform disposed between support structures locatable on the first and second sides of the vessel respectively; and a plurality of lift cable assemblies, each operably interconnecting a respective said winder and said platform, each said lift cable assembly having a first cable end portion windably engaged with one of said grooved sections and a second cable end portion windably engaged with the other grooved section, said cable assembly including at least two dependent cable portions that are disposed longitudinally intermediate said first and second end portions, each for movably interengaging a respective lower pulley carried by said platform, and at least one upper cable portion that is disposed longitudinally intermediate a respective pair of said dependent cable portions and interengaged with said support structure, whereby said winders are axially rotated in respective first directions by said respective motors to wind said cable end portions onto said respective grooved sections of said winders and raise said platform, and whereby said winders are axially rotated in respective, opposite second directions to unwind said cable assemblies from said winders and lower said platform.

16. The apparatus of claim 15 in which said support structure carries at least one upper pulley that is interengaged by a respective upper cable portion.

17. The apparatus of claim 15 including at least three lower pulleys for being movably interengaged by respective dependent cable portions, and further including at least a pair of said upper pulleys, each for being movably interengaged by a respective upper cable portion positioned longitudinally between respective adjacent pair of said dependent cable portions.

* * * * *